US006414661B1

(12) United States Patent
Shen et al.

(10) Patent No.: US 6,414,661 B1
(45) Date of Patent: Jul. 2, 2002

(54) METHOD AND APPARATUS FOR CALIBRATING DISPLAY DEVICES AND AUTOMATICALLY COMPENSATING FOR LOSS IN THEIR EFFICIENCY OVER TIME

(75) Inventors: Zilan Shen, West Windsor; Dennis Lee Matthies, Princeton; James H. Atherton, Ringers, all of NJ (US); Roger Green Stewart, Morgan Hill, CA (US)

(73) Assignee: Sarnoff Corporation, Princeton, NJ (US)

( * ) Notice: Subject to any disclaimer, the term of this patent is extended or adjusted under 35 U.S.C. 154(b) by 53 days.

(21) Appl. No.: 09/610,159

(22) Filed: Jul. 5, 2000

Related U.S. Application Data

(60) Provisional application No. 60/183,950, filed on Feb. 22, 2000.

(51) Int. Cl.[7] ..... G09G 3/00

(52) U.S. Cl. ..... 345/82; 345/46

(58) Field of Search ..... 345/82, 39, 83, 345/76, 80, 204, 44, 46, 78; 315/169.1, 169.3; 313/503, 504, 507; 428/690, 691; 257/88, 98; 340/815.45

(56) References Cited

U.S. PATENT DOCUMENTS

| | | | | |
|---|---|---|---|---|
| 5,793,344 A | | 8/1998 | Koyama | |
| 5,796,425 A | | 8/1998 | Minami et al. | |
| 5,949,194 A | | 9/1999 | Kawakami et al. | |
| 6,229,408 B1 | * | 5/2001 | Kane | 345/82 |
| 6,278,242 B1 | * | 8/2001 | Cok et al. | 315/169.1 |
| 6,323,631 B1 | * | 11/2001 | Juang | 323/315 |

FOREIGN PATENT DOCUMENTS

| | | |
|---|---|---|
| EP | 0923067 | 6/1999 |
| JP | 08197594 | 7/1996 |
| WO | WO 98/52182 | 5/1997 |

OTHER PUBLICATIONS

S. C. Thayer "Active–Driven TFEL Displays Using Ceramic Tiling", SID 93 DIGEST, pp. 618–621.

S. C. Thayer, "Late–News Paper: Modular Wall–Size IC–Driven Flat–Panel Displays", SID 92 DIGEST, pp. 950–953.

* cited by examiner

*Primary Examiner*—Chanh Nguyen
(74) *Attorney, Agent, or Firm*—William J. Burke

(57) ABSTRACT

A method and associated system that compensates for long-term variations in the light-emitting efficiency of individual organic light emitting diodes (OLEDs) in an OLED display device, calculates and predicts the decay in light output efficiency of each pixel based on the accumulated drive current applied to the pixel and derives a correction coefficient that is applied to the next drive current for each pixel. In one exemplary embodiment of the invention, the calculation is based the accumulated current that has been passed through the device. In another exemplary embodiment, the calculation is based on a difference in voltage across the pixel at two instants. The compensation system is best used after the display device has been calibrated to provide uniform light output. The present invention further provides a method for calibrating a display device comprising an array of individually adjustable discrete light emitting devices (pixels) using a camera having an array of radiation sensors or a single photodetector. According to this method, the camera captures respective images of substantially equal-sized first sub-areas and adjusts the driving current for each of said pixels within said first sub-areas to achieve a desired light output. Next, the camera captures images of a plurality of second sub-areas, each of the second sub-areas including multiple ones of the first sub-areas second-level sub-areas are adjusted such that each of the first-level sub areas provide substantially equal light output. In an alternative embodiment, each of the first level sub-areas overlaps and, after adjusting a first sub-area to a desired brightness level, the invention adjusts the pixels in each overlapping sub-area to have the same brightness as the overlapping pixels.

20 Claims, 6 Drawing Sheets

METHOD AND APPARATUS FOR CALIBRATING DISPLAY DEVICES AND AUTOMATICALLY COMPENSATING FOR LOSS IN THEIR EFFICIENCY OVER TIME

This patent application claims the benefit of priority from U.S. Provisional application No. 60/183,950 filed Feb. 22, 2000.

BACKGROUND OF THE INVENTION

1. Field of the Invention

This invention relates to calibrating and compensating electronic display devices and more particularly to a method and system for automatically maintaining the uniformity of the display output of a display including organic light emitting devices (OLED).

2. Description of Related Art

Organic light emitting devices ("OLEDs") have been known for approximately two decades. All OLEDs work on the same general principles. One or more layers of semiconducting organic material are sandwiched between two electrodes. An electric current is applied to the device, causing negatively charged electrons to move into the organic material(s) from the cathode. Positive charges, typically referred to as holes, move in from the anode. The positive and negative charges meet in the center layers (i.e., the semiconducting organic material), combine, and produce photons. The wavelength—and consequently the color—of the photons depends on the electronic properties of the organic material in which the photons are generated.

The color of light emitted from the OLED device can be controlled by the selection of the organic material. White light is produced by generating blue, red and green lights simultaneously. Specifically, the precisely color of light emitted by a particular structure can be controlled both by selection of the organic material, as well as by selection of dopants.

In a typical OLED, one of the electrodes is transparent and the cathode is constructed of a low work function material. The holes may be injected from a high work function anode material into the organic material. Typically, the devices operate with a DC bias of from 2 to 30 volts. The films may be formed by evaporation, spin coating or other appropriate polymer film-forming techniques, or chemical self-assembly. Thicknesses typically range from a few mono layers to about 1 to 2,000 angstroms.

OLEDs typically work best when operated in a current mode. The light output is much more stable and the gray scale of the device is easier to control for constant current drive than for a constant voltage drive. This is in contrast to many other display technologies, which are typically operated in a voltage mode. An active matrix display using OLED technology, therefore, requires a specific picture element (pixel) architecture to provide for a current mode of operation.

A commercially useful OLED should not only provide light output of sufficient luminosity for viewing in typical room ambient conditions but also provide a display that is uniform across the full viewing area. What this means is that each of the OLED pixels comprising the display are driven so that they all produce the same luminous output for a given input signal. The visibility of variations in the display depends on the spatial frequencies displayed in the underlying image and on the spatial frequencies in the variations. For example, relatively large errors may be tolerated in images that have high spatial frequency content. Furthermore, relatively large errors that exhibit low spatial frequency content, such as a variation that occurs gradually across an entire display, may be tolerated. Errors of this type of as much as 2% may be imperceptible to the ordinary viewer. Pixel-to-pixel errors, however, are desirably kept to less than 1%. Thus, it is desirable to control the gray scale variations in the output of individual pixels to be equal to or less than about 0.8% for most applications. As used herein, the terms "picture element" and "pixel" indicate both a single light emissive point and a group of closely-spaced light emissive points.

Non uniformities in pixelated display devices may be due to manufacturing non uniformities resulting in pixels with slightly different light output for the same driving current and to non uniformities due to aging of the pixels. The first type of non uniformity may be corrected with the application of a first correction coefficient that is stored in a memory and applied to the driving signal of each pixel prior to driving the pixel. The second type, however, requires continuing re-calibration of the display device during its lifetime to determine changes in pixel output uniformity. Such a process is not only expensive but oftentimes impractical.

OLED based displays are particularly vulnerable to developing time dependent uniformity changes. For example, in a display operated at a constant current density of 2.5 $mA/cm^2$ and after an initial "burn in" time of about 100 hours, the light output of the OLED decays from 150 $cd/m^2$ to 110 $cd/m^2$ after 3000 hours of operation, where operating voltage increases from 3.1 to 4.1 Volts. Because the luminous efficiency of a pixel varies with the total amount of light it produces, adjacent pixels in a display may age differently. Thus, an initially calibrated uniform display may develop non-uniformities over time, which depend on the driving history of each pixel. These non-uniformities may require periodic optical calibration to maintain a uniform display. Other types of emissive displays and transmissive displays may also develop non-uniformities due to long-term differences in the activation of pixels. If for example, the image on an initial input screen is displayed when a computer monitor is not in use for a prolonged period of time, for example, overnight for several months, that image may persist on the display device even when all image pixels are driven to what should be a uniform value. This type of persistent image may occur on cathode-ray tubes, field-emissive displays, electroluminescent displays and liquid crystal displays.

Additionally, determining whether a display is uniform is not always an easy proposition, because as was stated earlier, in the best conditions, an observer can detect intensity variations of only 0.8% or more. There is therefore needed not only for a method to rapidly and accurately correct resulting non uniformities of an initially calibrated display during its life, but a method for measuring such uniformities with better accuracy than the accuracy provided by visual observation in a manner that is easy to implement.

SUMMARY OF THE INVENTION

The present invention is embodied in a method and associated system that calculates and predicts the decay in light output efficiency of each pixel beginning from a starting measured level based on actual integrated drive current applied to each pixel and derives a correction coefficient that is applied to the next drive current for each pixel.

In one exemplary embodiment of the invention, the calculation is based on the following equation that predicts the current needed at a present period to produce the same output as in a previous period:

$$I_N = I_{N-1} \exp[I_{N-1}\Delta t_{N-1}/I_o\tau_o].$$

In this example, $I_o$ is the initial condition and $\tau_o$ is the corresponding delay time, which may be measured during an initial "burn-in" interval. The value of $I_o$ is preferably determined after the burn in interval and after the calibration of the light output of an OLED panel using, for example, a CCD camera to provide an output signal indicative of the light output of the OLED panel that is substantially the same for each individual pixel of the display panel and substantially constant across the full panel.

In another exemplary embodiment of the invention, the calculation is based on an instantaneous current-voltage characteristic of the image pixel. The difference in voltage across the pixel needed to produce a predetermined current is measured and is used to index a table of stored values, the stored values indicate a current level that provides a desired brightness in the displayed pixel.

The present invention also provides a system that corrects non uniformities in the light output of an electronic display device including a plurality of addressable discrete picture elements (pixels), each of the pixels driven by a driving current and each pixel having a light output that is a function of the driving current. The system includes:

a) an accumulator that integrates the driving current for each of the pixels during the elapsed time;

b) circuitry responsive to the integrated current value for calculating a corrected driving current, b) correction apparatus for applying the corrected current to each of the plurality of pixels.

The present invention further provides a method for calibrating a display device comprising an array of individually adjustable discrete picture elements (pixels) using a radiation sensor that may be a single radiation sensing device or using a camera comprising an array of radiation sensing devices, the method comprising:

a) observing with the radiation sensor a first area of the display device array forming a first level sub-array comprising a first number of pixels and adjusting each of the pixels within the first sub-array to a desired light output;

b) observing with the radiation sensor a second area forming a first level second sub-array and again adjusting each of the pixels within the second sub-array to the desired light output;

c) repeating steps (a) and (b) until all of the display pixels have been adjusted to the desired output.

According to one aspect of the invention, the method further includes the steps of:

d) observing with radiation sensor another first area of the device array containing a plurality of the first level sub-arrays to form a second level sub-array;

e) adjusting as a unit each of the first level sub-arrays in the second level sub-array, to the desired output;

f) observing, with the radiation sensor, another second level sub-array containing a plurality of the first level sub-arrays to form an other second level sub-array;

g) adjusting as a unit each of the first level sub-arrays in the other second level sub-array, to the desired output;

h) repeating steps (e) through (g) until all of the display first level sub-arrays have been adjusted to the desired output;

i) repeating steps (e) through (h) with successively larger sub-arrays until the sub-arrays reach the size of the display array.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DESCRIPTION OF THE EXEMPLARY EMBODIMENTS

Figure 1:
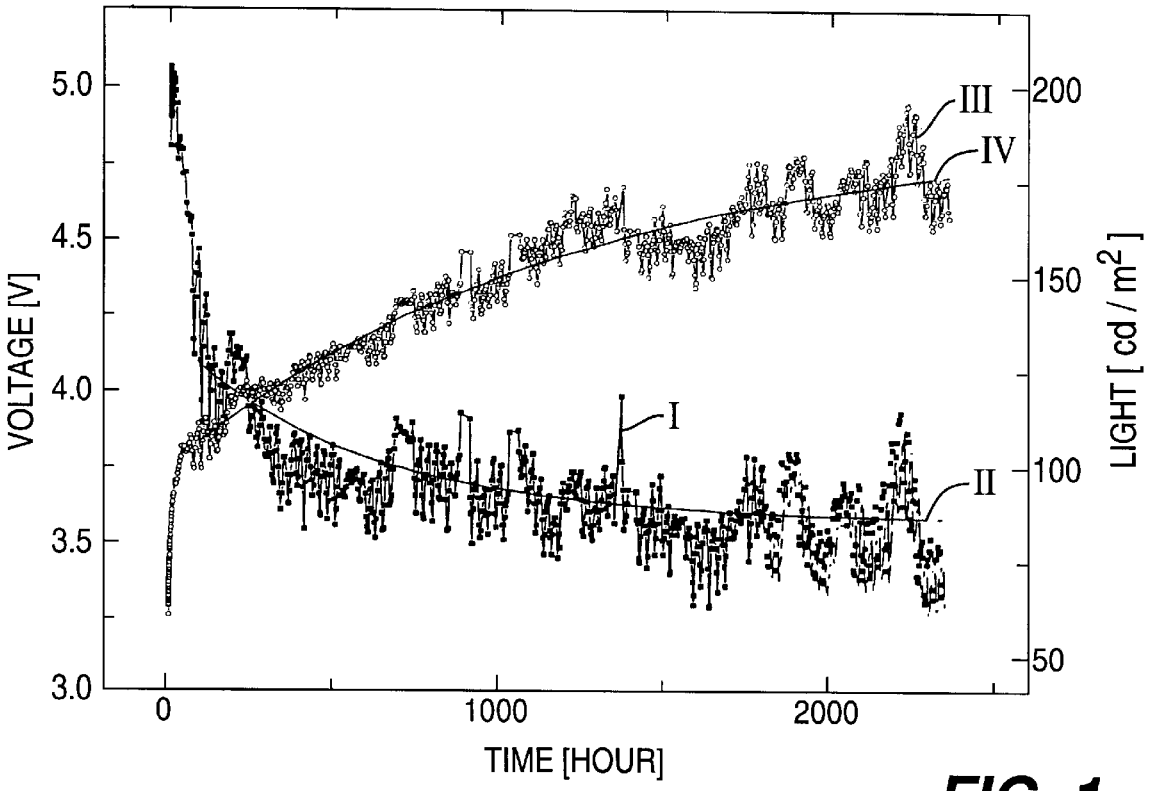
FIG. 1 is a graph of light versus time and a graph of voltage versus time that shows an efficiency decay when a constant current is applied to a typical OLED material.

Throughout the following detailed description, similar reference characters refer to similar elements in all figures of the drawings.

The efficiency of an OLED device decays over time even when the OLED device is driven with constant current levels. For example, at a constant current density level of 2.5 mA/cm$^2$ (milliamperes per square centimeter) after an initial "burn in" time of 100 hours, the OLED light output decays from about 150 cd/m$^2$ (Candelas per square meter) to about 110 cd/m$^2$ over a period of 3000 operating hours. At the same time the operating voltage increases from 3.1 Volts to 4.1 Volts. Thus, even when driven by circuitry that compensates for I-V shifts over time to provide a substantially constant current to the OLED devices, the display develops non uniformities over time that are dependent on the amount of time and degree to which each pixel of the display has been driven.

FIG. 1 shows a simplified graphical representation of the typical change in OLED output intensity (curve labeled I)as a function of operating time for a constant current density. After a "burn-in" period of approximately 100 to 200 hours, the intensity variation follows the general shape of an exponential decay curve (curve labeled II). FIG. 1 also shows the corresponding increase in voltage (curve labeled III) needed to produce the constant current density. Again after the burn-in period, the voltage curve is generally inversely proportional to an exponential decay (curve labeled IV).

At any time "t" the Luminance "L" of any OLED pixel is approximately proportional to the current (I) in the pixel as set forth in equation (1):

$$L(t)=\eta(t)*I(t) \quad (1)$$

where L represents the luminance of the pixel, $\eta$ represents the pixel efficiency in converting current, and "I" represents the current passing through the light emitting material. The efficiency as a function of time may be approximated by an exponentially decaying curve. When the decay rate is set to be proportional to the total number of charges that pass through the light emitting device the relationship between efficiency and current as functions of time as shown in equation (2) is obtained:

$$\eta(t)=\eta_o \exp[-\int I(t)dt/I_o\tau_o] \quad (2)$$

where $\eta_o$ is the initial efficiency, $I_o$ is the initial current, and $I_o\tau_o$ represents the decay characteristic of the device. The efficiency decay is not an exact exponential curve. In particular, $I_o\tau_o$ is also a function of time and its rate of change becomes smaller after the first few hundred hours of operation. To better model the OLED behavior over time, it is desirable that $\tau_o$ be defined at t=100 to 200 hours, that is after an initial "burn in" period.

In the exemplary embodiment of the invention, the display device is burned-in by applying a constant current density to all pixels in the display device for 10 hours and then monitoring the device for 90 hours to determine the respective slopes of the current-time curves for all of the pixels. Alternatively, the display may be "burned-in" by other means, for example by placing the display in a controlled environment at an elevated temperature for a predetermined time period and then applying a predetermined current density to each pixel in the display for a shorter time period (e.g. 10 hours) to determine the slope of the current-time curve.

In an alternative embodiment of the invention, described below with reference to FIG. 9, the instantaneous change in voltage across a pixel needed to produce a desired current may be used to determine the correction needed to produce a desired brightness level. This embodiment uses a characteristic current-voltage curve for each pixel. This curve may be determined, for example, by monitoring the current-voltage characteristics of the device during the burn-in period.

These models of the decay in efficiency of an OLED display device permit the implementation of a correction process whereby the current applied to each pixel to obtain a requested light output level, becomes a function not only of the requested pixel output signal, but also of the prior history of the pixel. The prior history is used to predict and compensate for change in the efficiency of each pixel based on prior pixel history, thereby obtaining a more uniform output, as described by equation (3):

$$I(t)=I_o\eta_o/\eta(t) \quad (3)$$

substituting equation (2) into equation (3) produces equation (4):

$$I(t)=I_o \exp[-\int I(t)dt/I_o\tau_o]. \quad (4)$$

In other words, the driving current during any period N can be expressed as a function of the accumulated current determined during the immediately preceding period N−1 by equation (5):

$$I_N=I_{N-1} \exp[I_{N-1}\Delta t_{N-1}/I_o\tau_o] \quad (5)$$

where $\Delta t_{N-1}$ is the period of time during which an OLED pixel is driven by a current $I_{N-1}$.

Figure 2:
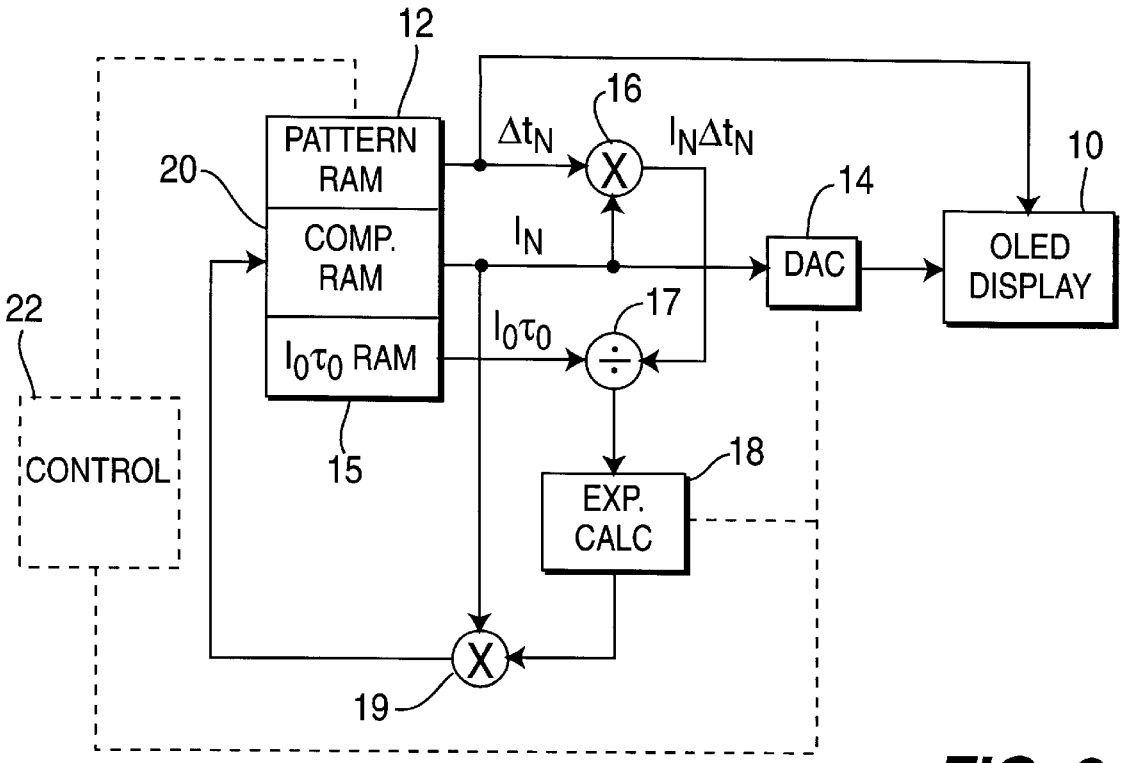
FIG. 2 is a block diagram of an exemplary system for implementing the present invention.

FIG. 2 shows a block diagram of a display system 100 that includes a current correction system that operates as described above. As shown in FIG. 2 the system 100 includes three RAMs (Random Access memories) 12, 20 and 15. While shown as three distinct memories, the three memories can of course be sections of a single physical memory, as well as three physically distinct memories. Memory 12 provides the time division ($\Delta t_N$) gray scale signal, preferably as an 8 or 10 bit signal, to the OLED display 10. The OLED display loads the digital values provided by the pattern RAM 12 into its column drivers (not shown) to control the amount of time that the driving current is applied to the addressed pixel in the display 10 that is to say the sub-frames in which the pixel is turned on in any given frame interval.

The compensation RAM 20 provides the driving current, $I_n$, for the pixel to the OLED display 10 via a digital to analog converter (DAC) 14. Each column driver for the OLED display 10 may include, for example, a digital to analog converter (not shown) that provides a pulse having a width proportional to $\Delta t_N$. This pulse controls the amount of time that the current value $I_n$ is applied to the pixel.

In the exemplary embodiments of the invention, the value of $I_n$ is set for each pixel to produce uniform illumination across the display. Gray scale is achieved by controlling the amount of time that each pixel is illuminated using the values $\Delta t_N$.

The output signals of the RAMs 12 and 20 are also applied to respective input ports of a digital multiplier 16 to produce a signal $I_N\Delta t_N$. This signal is applied to one input port of a divider 17, the other input port of which is coupled to receive the value $I_o\tau_o$ from RAM 15. RAM 15 holds a value $I_o\tau_o$ (preferably 8 to 10 bits) for each pixel in the OLED display device 10. This value represents the current applied to the pixel at the end of the burn-in interval in order to produce a desired brightness level. Divider 17 divides the signal $I_N\Delta t_N$ by the value $I_o\tau_o$ to produce an output signal $I_N\Delta t_N/I_o\tau_o$.

Block 18 represents another step in the correction process, an exponentiation calculator that computes the value exp $[I_N\Delta t_N/I_o\tau_o]$. There are different ways to perform the above calculations. For example, the system may use a computer to perform both calculations in blocks 16, 17 and 18 in software, or it may use special purpose digital hardware or analog hardware. The exemplary embodiment of the invention uses analog circuitry shown in FIG. 3 to perform the exponentiation operation. In this circuitry, the signal $I_N\Delta t_N/I_o\tau_o$ is first divided, in divider 31, by the constant quantity q/kT, provided by a constant value source (e.g. register) 33, where q is the charge of an electron in coulombs, k is Boltzmann's constant and T is the temperature in degrees Kelvin.

The output signal provided by the divider 31 is applied to a digital to analog converter 35 that is coupled to drive a variable voltage source 37. Voltage source 37 is coupled to the emitter and base electrodes of a transistor 39. The base electrode of the transistor 39 is also coupled to a current source 41 to receive a predetermined base current $i_b$. The emitter electrode is coupled to a source of relatively positive operational power (e.g. ground). In this configuration, the output signal, $i_c$, provided at the collector of the transistor 39 is proportional to $\exp[I_N\Delta t_N/I_o\tau_o]$. The proportionality constant is the value of $i_b$. In the exemplary embodiment of the invention, $i_b$ is selected to bias the transistor 39 to produce a good exponential curve over the possible range of values that the signal $I_N\Delta t_N/I_o\tau_o$ may have.

The output signal $i_c$ provided by the transistor 39 is converted into a voltage using a current-to-voltage converter 43 (e.g. a resistor), that is coupled between the collector of transistor 39 and a source of relatively negative operating potential (e.g. V−). The voltage output signal provided by the converter 43 is applied to an analog to digital converter 47 to generate a digital output signal that is proportional to $\exp[I_N\Delta t_N/I_o\tau_o]$. This signal is applied to one input port of a multiplier 19, shown in FIG. 1. The other input port of the multiplier is coupled to receive the signal $I_N$ provided by the compensation RAM 20. The output signal of the multiplier 19 is a value $I_N \exp[I_N\Delta t_N/I_o\tau_o]$, that, as set forth in equation (5), is the compensated current value $I_{N+1}$. This value is then stored into the compensation RAM 20 to replace the value $I_N$.

The output value provided by the multiplier 19 represents the change in the current used to compensate for the OLED loss in efficiency over time.

Depending on the actual efficiency characteristics of a particular OLED, be it a rapid loss or a more gradual loss, the current adjustment may occur with every frame or every M number of frames. In the latter case, a current measurement for any one pixel may be made several times during the M frame interval and the value of $I_N\Delta t_N/I_o\tau_o$ may then be averaged over all of the measurements. The adjusted current value stored into the compensation memory 20 after M frames would be given by equation (6):

$$I_{N+1}=I_N \exp[MI_N\Delta t_N/I_o\tau_o]. \quad (6)$$

Figure 3:
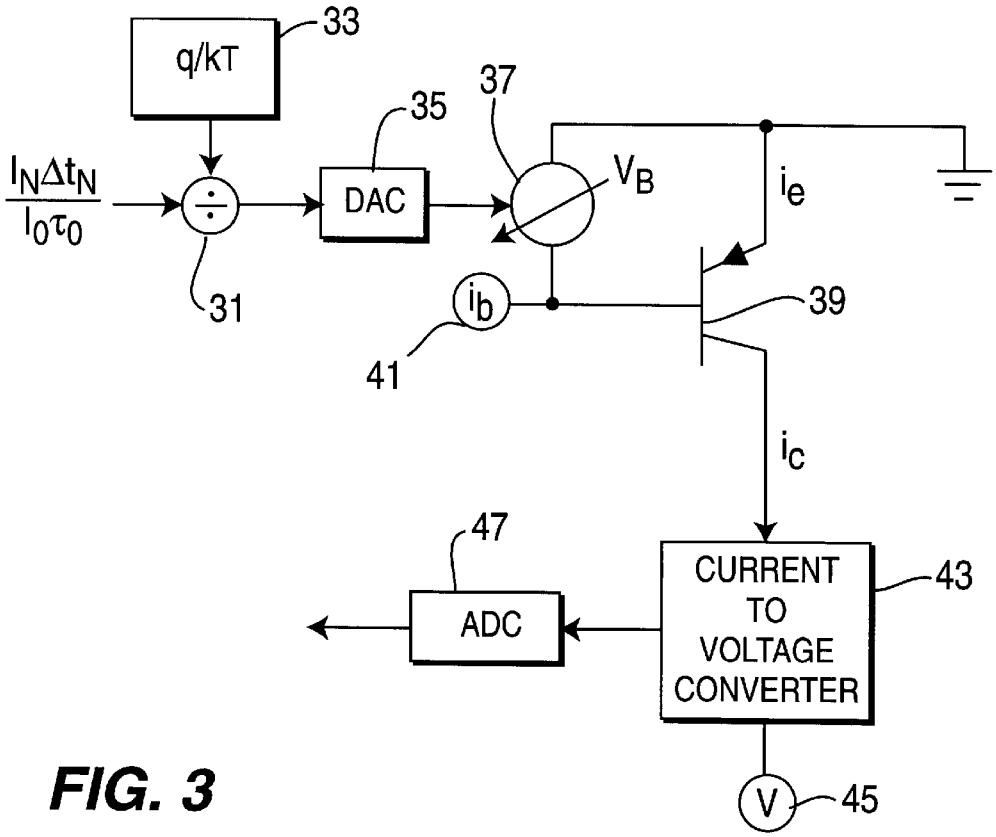
FIG. 3 is a schematic diagram, partly in block diagram form of a circuit useful in implementing analog signal exponentiation.

The system shown in FIG. 2 is controlled by a controller 22 that may be a computer which controls all functions of a display system including functions not shown in FIGS. 2 and 3.

As mentioned hereinabove, the exponential decay is only an approximation which works best after the initial "burn in" time has elapsed. Such "Burn in" time determines the initial values for $I_o$ and $\eta_o$. It is therefore important to (a) select a time when the very rapid decay in the light output of the OLED is complete and (b) calibrate the system output to provide a uniform initial output.

Figure 9:
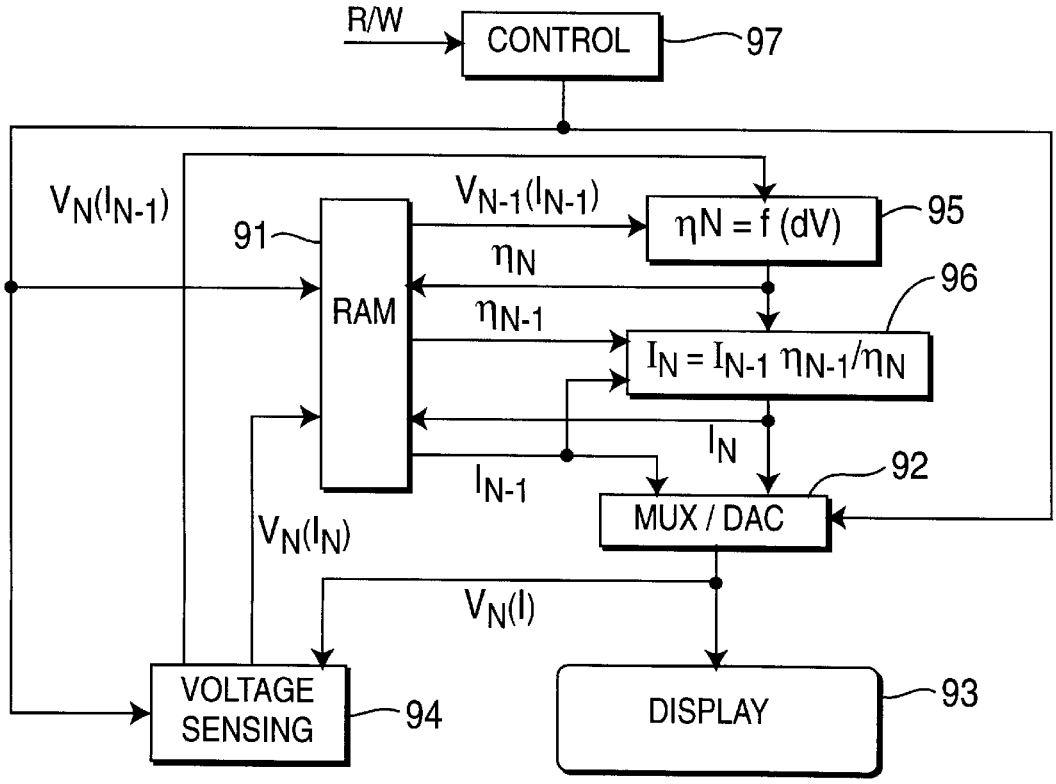
FIG. 9 is a block diagram of an alternative exemplary system for implementing the present invention.

FIG. 9 is an alternative embodiment of a correction system that may be used instead of, or in addition to, the correction system shown in FIG. 2. FIG. 9 also includes a RAM 91 that holds values $V_N(I_{N-1})$, $V_N(I_N)$, $\eta_N$ and $I_N$. The memory 91 also holds values $\Delta t_N$ as the pattern RAM but, for the sake of simplicity these are not shown in FIG. 9. Voltage sensing circuitry 94 is coupled to the display device 93 to measure the voltage across each image pixel as a current IN determined by the multiplexer/digital-to-analog converter (mux/DAC) 92 is applied to the pixel. This voltage $V_N(I_N)$ is applied by the voltage sensing circuitry 94 to one section of the memory 91. The mux/DAC 92, under control of the controller 97, also applies the current from the previous interval $I_{N-1}$ to the pixel so that the voltage sensing circuitry 94 can determine a measurement for the voltage produced in the present time interval in response to the current for the previous time interval that is, $V_N(I_{N-1})$. The voltage level $V_N(I_{N-1})$ is applied to circuitry 95 that calculates a value $\eta_N$ which is used to determine the current level needed to produce the desired brightness during the present time interval. The second signal input to the circuitry 95 is a value for the voltage on the pixel during the previous time interval, $V_{N-1}(I_{N-1})$, provided by the memory 91 responsive to the controller 97.

The value $\eta_N$ provided by the circuitry 95 is a function of the difference between the voltages $V_N(I_{N-1})$ and $V_{N-1}(I_{N-1})$, in other words, the difference in the voltage across the pixel during the current interval and during the prior interval in response to the same current. This function is proportional to the inverse of the curve IV shown in FIG. 1 after the 100 hour burn-in interval. This function approximates an exponential decay. In the exemplary embodiment of the invention, the circuitry 95 is special purpose digital processing circuitry (e.g. a read-only memory) that is preprogrammed with this function for each pixel. Alternatively, the circuitry may be analog circuitry, such as is shown in FIG. 2, or the calculation performed by block 95 may be performed by the controller 97 or other general purpose processor.

The output value $\eta_N$ provided by the circuitry 95 is applied to the memory 91 for use as the value $\eta_{N-1}$ during the next interval and to a current calculation block 96. The current calculation block calculates the current $I_N$ to be applied to the display device during the present time interval using the equation:

$$I_N=I_{N-1}\eta_{N-1}/\eta_N$$

The values of $\eta_{N-1}$ and $I_{N-1}$ are obtained from the memory 91. The resulting value $I_N$ is stored into the memory 91 to be used as the value $I_{N-1}$ during the next update interval. As shown in FIG. 9, all of the blocks, 91, 92, 94, 95 and 96 are controlled by the controller 97. For a given pixel, the controller causes the circuitry shown in FIG. 9 to perform the following steps. 1) apply current $I_{N-1}$ to the pixel; 2) measure and digitize voltage $V_N(I_{N-1})$ and apply to calculation block 95; 3) apply stored voltage $V_{N-1}(I_{N-1})$ from memory 91 to calculation block 95; 4) calculate $\eta_N$ and apply to memory 91 and to calculation block 96; 5) read $\eta_{N-1}$ from memory 91 and apply to calculation block 96; 6) calculate $I_N$ and apply to memory 91 and to display 93; 7) measure and digitize $V_N(I_N)$, apply to memory 91.

In addition, as set forth above, the exponential correction performed by the circuitry shown in FIGS. 2, 3 and 9 yields only an approximate correction. Over time, errors in the decay characteristics of individual pixels may diverge. Accordingly, the display may need to be calibrated periodically to produce uniform illumination.

It may be desirable to periodically recalibrate OLED displays as well as other types of emissive and transmissive displays to compensate for persistent images that show on the display device even when all of the pixels are driven to what should be a uniform illumination. As described above, this occurs when a single image is displayed for a relatively large percentage of the time, for example, a data input form or other image that is displayed when a computer system is inactive for long periods of time.

When the display device is a tiled display, it may be necessary to change tiles from time to time, for example, to correct for a defective pixel. After changing a tile, it is desirable to recalibrate the entire display to ensure uniform illumination.

There are a number of ways known in the art to perform such initial (or subsequent) display output calibration. It has been found that human eyes can detect gray-scale variations as small as 0.8% when an image or display is viewed at optimal distance. Thus a seamless tiled display requires that each pixel is driven with the correct current to limit the error in the output to 1% or better over the full display. This requires an accurate and useful measurement of the individual pixel brightness.

An exemplary way to measure the light output of the pixels of a display device, and thereby calibrating individual pixels, is to use a CCD camera. CCD cameras generate a measurable output that may be compared accurately, pixel by pixel, to assist the calibration process. There is, however, a problem when CCD cameras are used to calibrate pixelated displays. This problem occurs because of the dead spaces in regular arrays between both the individual display pixels and the CCD camera individual radiation detectors. When the two images are superposed it has been found that there is produced Moiré patterns that induce errors in the calibration process. This effect is more pronounced as the number of display pixels is large compared to the number of pixels in the imager of the CCD camera.

In order to obtain meaningful calibration using a CCD camera to establish initial conditions, or to recalibrate the OLED display or any other pixelated display, it is proposed according to the present invention to use one of two methods. Using either a CCD camera or a single detector (e.g. a photodiode) to detect the emitted light.

Figure 4A:
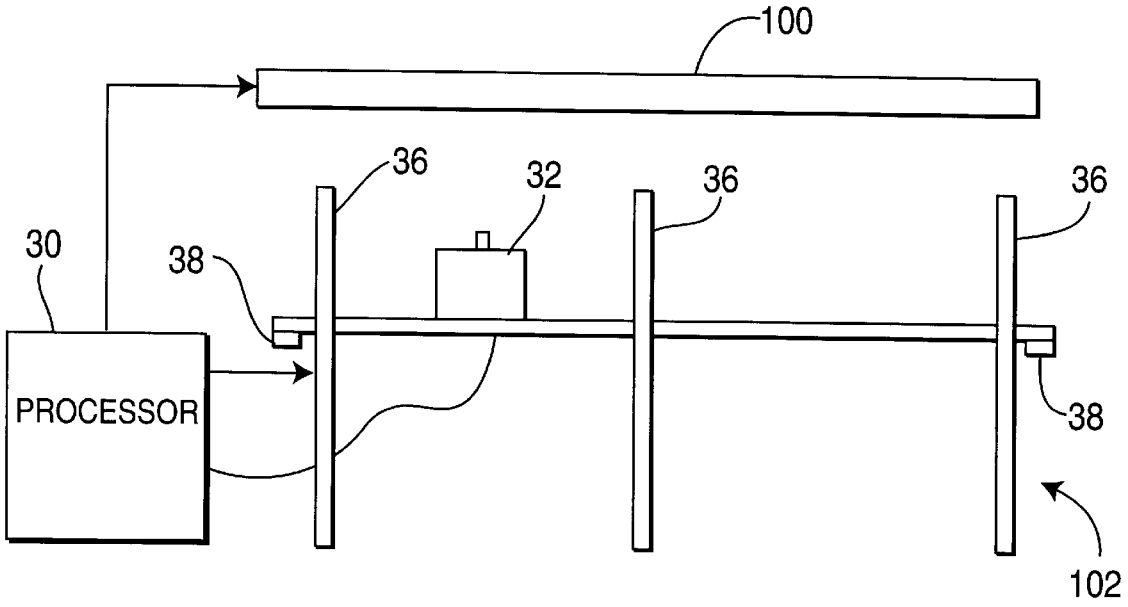
FIG. 4A is a top plan view of a calibration system according to the present invention.
Figure 4B:
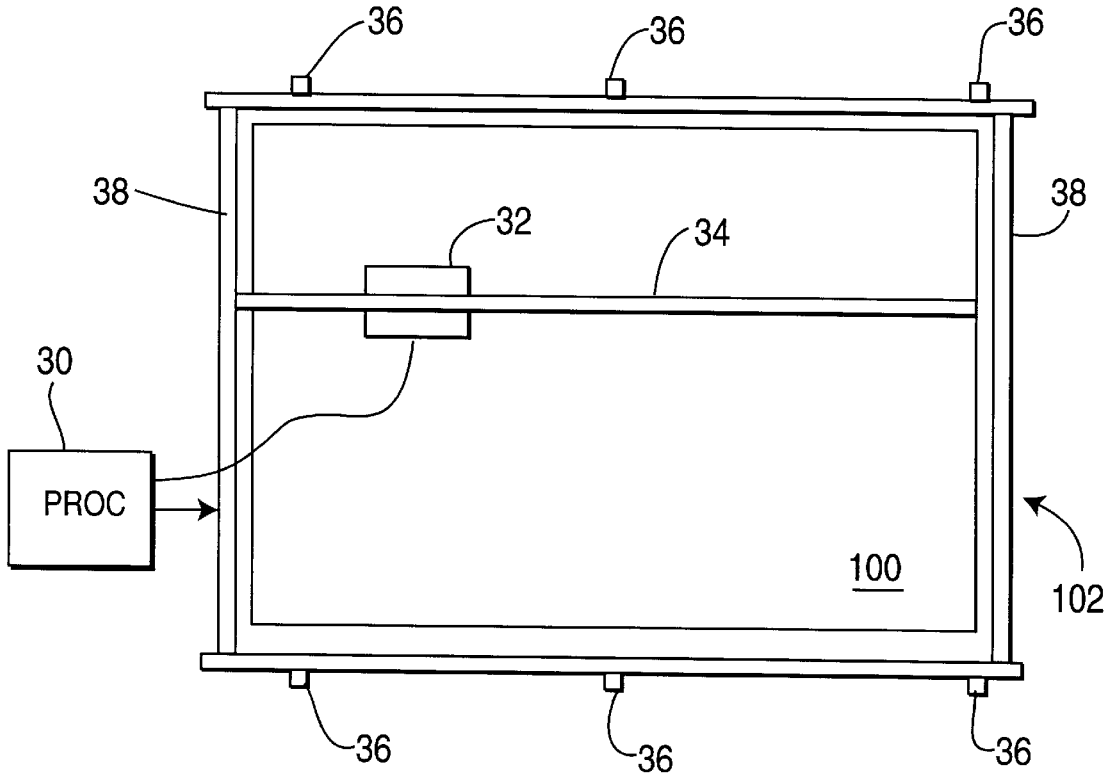
FIG. 4C is an elevation view of the calibration system shown in FIG. 4A.

FIG. 4A is a top-plan view and FIG. 4B is an elevation view of exemplary apparatus that may be used to perform the calibration processes described below. The exemplary apparatus is for a wall-sized seamless tiled display. The exemplary apparatus includes a camera 32 mounted on an XYZ translation stage 102. It is contemplated, however, that the camera 32 may be replaced by a single photodetector (not shown). The translation stage 102 includes a horizontal track 34 on which the camera 32 may move to the left or right. The horizontal track 36 is coupled to vertical tracks 38 on which the horizontal track may move up or down. A frame including the horizontal track 34 and vertical tracks 38 is, in turn, mounted on depth translation tracks 36 so that it may move toward or away from the display system 100. The motion of the translation stage 102 and the position of the camera 32 is controlled by a processor 30. In the exemplary embodiment of the invention, the processor 30 also receives the output signals of the CCD camera 30 and provides data on pixel current adjustments to the display system 100.

Figure 5B:
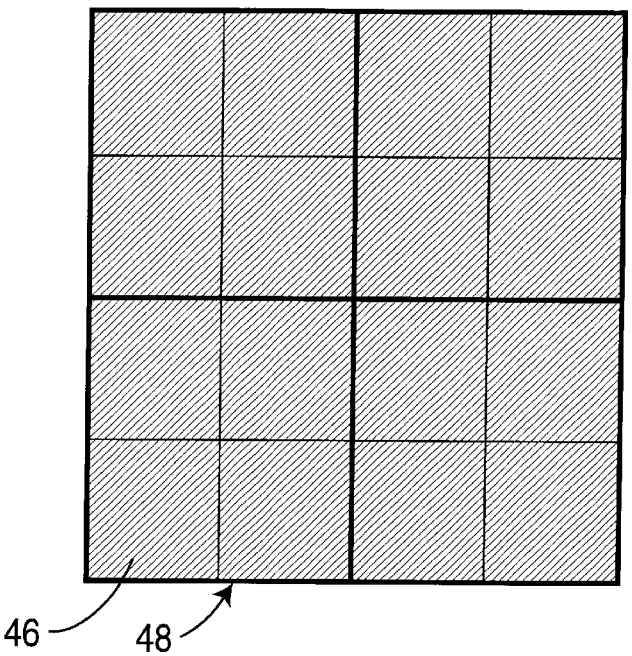
FIG. 5B is an image diagram showing the field of view and camera center in a second step during the process of implementing calibration of a display device using the apparatus shown in FIGS. 4A and 4B.
Figure 5A:
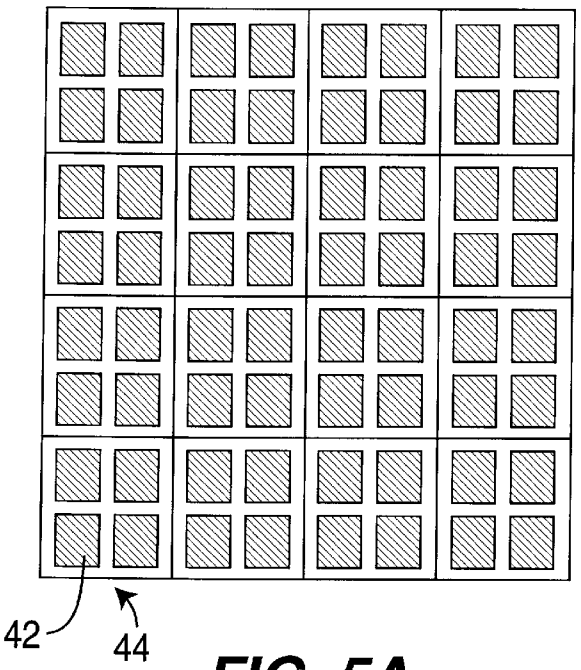
FIG. 5A is an image diagram showing the field of view and camera center in a first step during the process of implementing calibration of a display device using the apparatus shown in FIGS. 4A and 4B.

The first of the two calibration methods to be described may be referred to as the pyramid method. This method is a sorting method where ever increasing areas of the display are treated as a single pixel. Thus, as illustrated in FIG. 5A, initially the CCD camera is focused on a small area 42 of the display, comprising, for example, four pixels 44 if a CCD camera is used or a single pixel if a photodetector is used. The light output of these four pixels is then each adjusted to be within the required 1% or better of a desired pixel brightness value (PBV). If a single photodetector is used, the device may be arranged in this initial stage to focus the light of a single pixel onto the photodetector.

After imaging the first group of four pixels the camera moves to capture an image of the next four pixels, and the process is repeated. Once all of the display has been adjusted in four by four segments (or pixel by pixel if a single photodetector is used) the camera zooms out so that a new area 48 is viewed, as shown in FIG. 5B, this time each area comprises 16 (4) pixels which are treated as four super pixels 46. The output of each superpixel is treated as a single unit, and is adjusted so that each of the four super pixels is within the required luminous variation limits of all of the other super pixels 46. Again all of the display area is so adjusted using the 16 (4) pixel groupings. Next the camera is zoomed out again picking up a new larger area of super pixel groups (e.g. four 16 by 16 (4 by 4) super pixel groups). The adjustment process continues until the groups of super pixels being adjusted correspond to the entire image. This method avoids errors due to Moiré patterns because, at the individual pixel level, the light from each pixel is imaged by an array of pixels in the camera 32. As the camera zooms out and there is closer to a one-to-one relationship between display pixels and camera pixels, the brightness adjustment being performed is only to calibrate the brightest pixels in each pixel group to each other. Accordingly, Moiré patterns on the image are ignored. Of course, if a single photodetector is used, it is unlikely that any Moiré patterns will interfere with the measurement.

Figure 7:
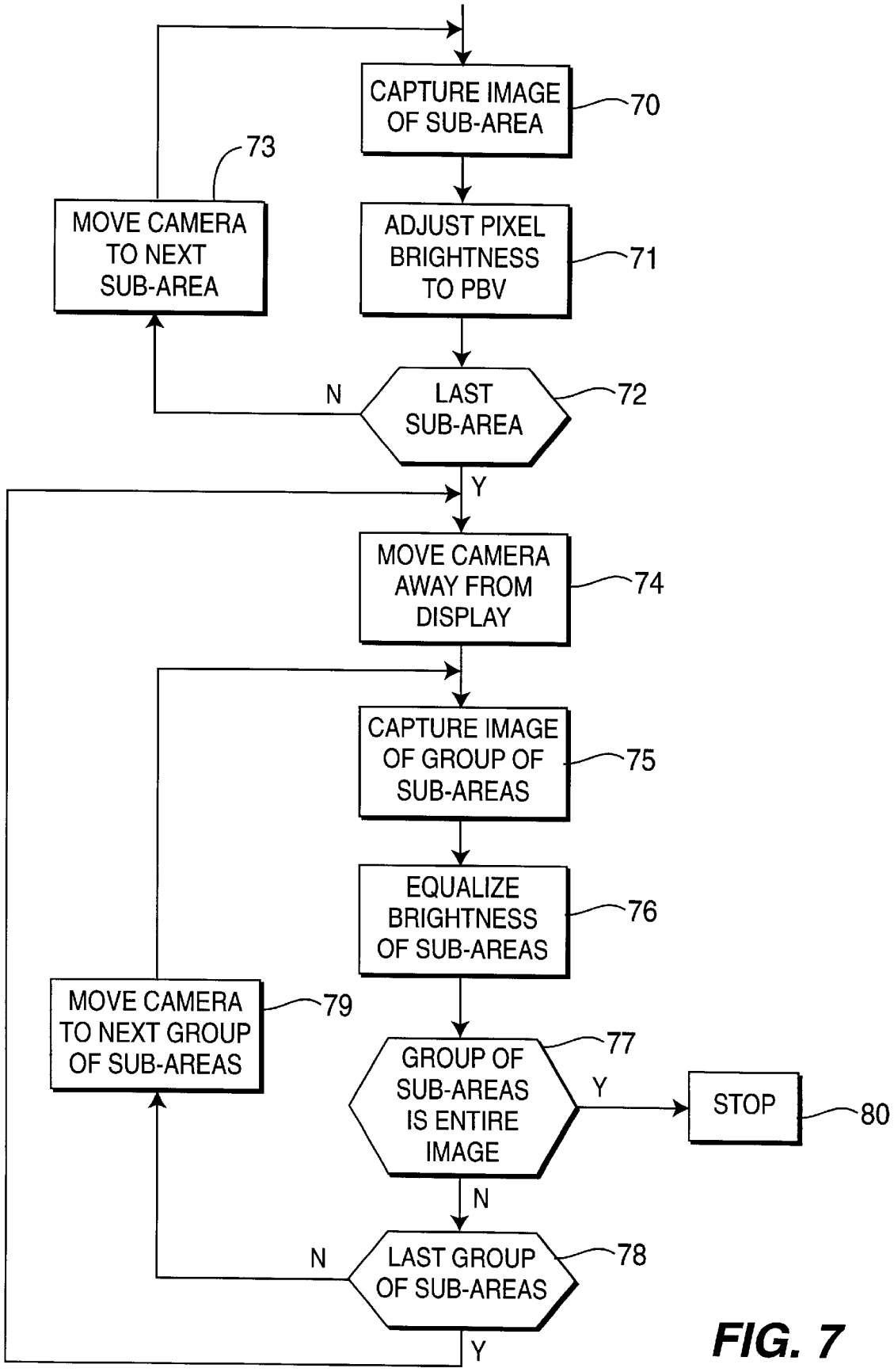
FIG. 7 is a flow-chart diagram that is useful for describing the calibration process shown in FIGS. 5A and 5B.

A flow-chart diagram illustrating this calibration operation is shown in FIG. 7. This process begins by illuminating the entire display device at what should be a uniform illumination level. Next, at step 70 a first sub-area of the display 10 (shown in FIG. 2) is imaged. At step 71, the calibration system changes the values in the compensation RAM 20 (shown in FIG. 2) to adjust the brightness of each pixel to be as close as possible to the desired pixel brightness value, PBV. At step 72, the process determines if the sub-area being calibrated is the last sub-area in the display. If it is not, control transfers to step 73 which moves the camera to obtain an image of the next adjacent sub-area. After step 73, steps 70, 71 and 72 are repeated. These steps scan the entire display, for example, from side to side and from top to bottom until all of the sub-areas have been calibrated.

When step 72 indicates that the last sub-area has been processed, control transfers to step 74 in which the camera is moved away from the display. At step 75, the process captures an image of a group of the sub-areas from the next lower level. At step 76, the process changes the current values for entire sub-areas to equalize the light output of the various sub-areas that are currently being imaged. At step 77, the process determines if the current group of sub-areas spans the entire image. If not, control transfers to step 78 which determines if the current group of sub-areas is the last group of sub-areas at this level in the image. If this is not the last group of sub-areas then control transfers to step 79 which moves the camera into a position to capture the next group of sub-areas. After step 79, control transfers to step 75 to equalize the newly imaged sub-areas.

If, at step 77, the last group of sub-areas at this level has been processed, control transfers to step 74 to move the camera away from the display so that sub-areas at the next higher pyramid level can be captured and processed. This process continues until the sub-area being imaged spans the entire display. When this occurs, step 77 transfers control to step 80 which ends the calibration process.

Figure 6:
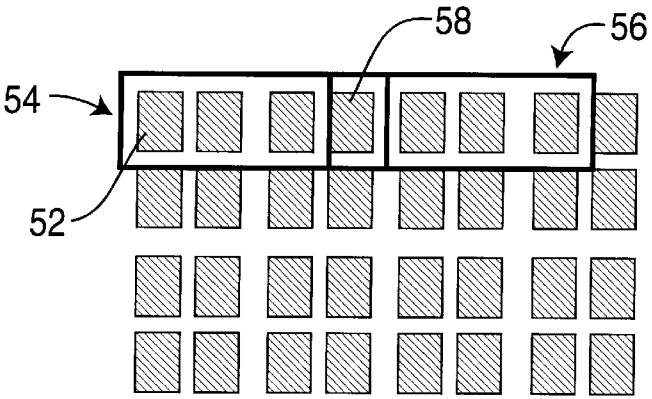
FIG. 6 is an image diagram showing two sub-areas in the camera field of view according to a second process of implementing calibration of a display device using the apparatus shown in FIGS. 4A and 4B.

A variation of the pyramid calibration scheme is shown in FIG. 6. This variation can not be easily implemented with a single photodetector. In this case, the camera is displaced along one dimension of the display to image successive overlapping sub-arrays of pixels. In the exemplary embodiment shown in FIG. 6, after calibrating a first sub-array 54 containing pixels 52, the CCD camera moves sideways to a next adjacent sub-array 58 of the same size. In this process, however, the last pixel (56) row or column of the each sub-area is included as the first pixel (56) row or column respectively of the next sub-array. The brightness of each pixel in the remaining rows and/or columns is adjusted to be within the desired limits relative to the pixel in the overlapping row or column. The process may stop after one scan of the full array of the display or the process may use progressively larger sub-arrays as superpixels, as for the previously described method.

Figure 8:
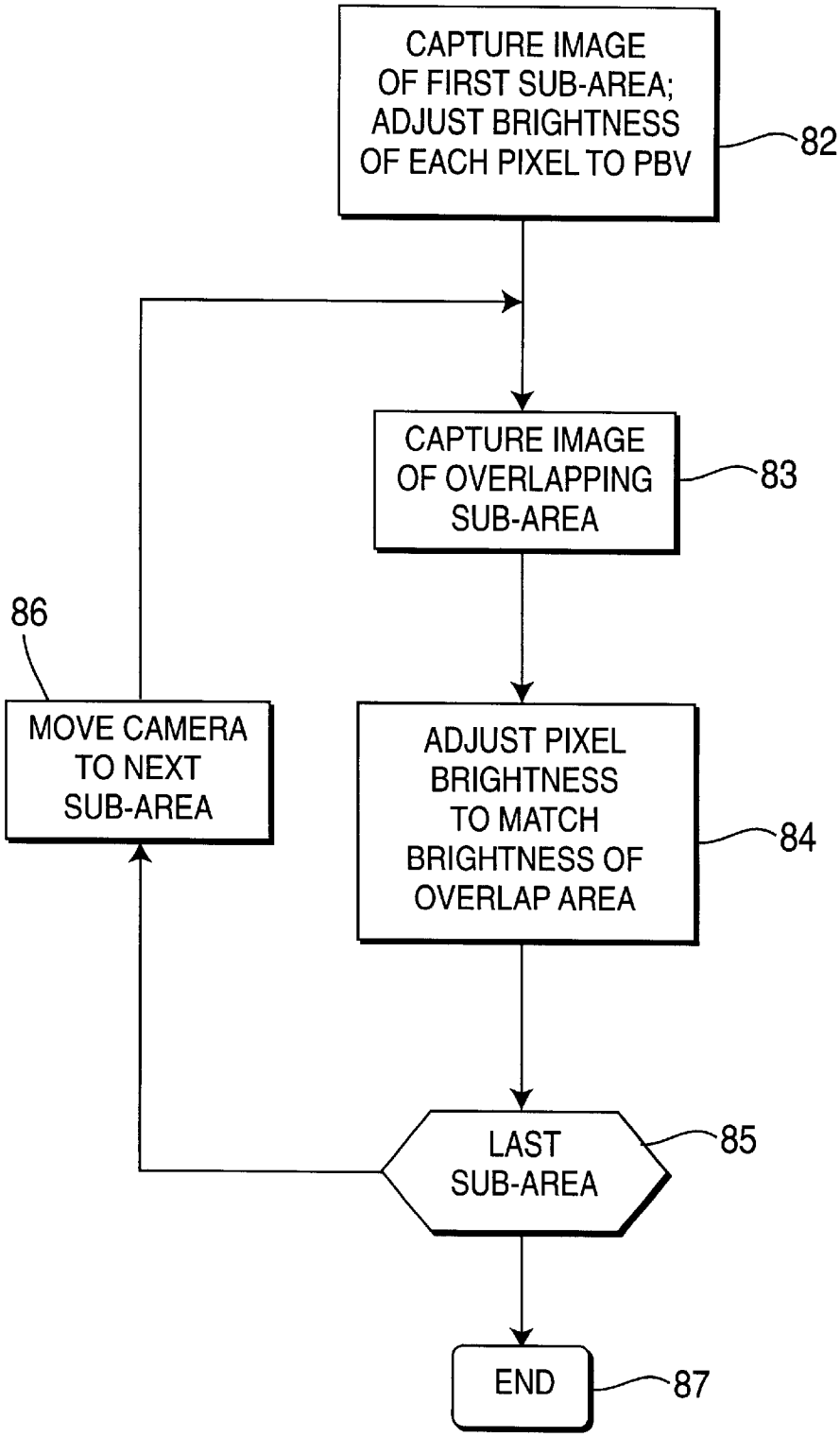
FIG. 8 is a flow-chart diagram that is useful for describing the calibration process shown in FIG. 6.

FIG. 8 is a flow-chart diagram that illustrates this process. As with the process shown in FIG. 7, the process in FIG. 8 begins by displaying an image which should have a desired uniform pixel brightness value (PBV). At step 82, a first sub-area of the image is captured and the brightness of all of the pixels in the sub-area is adjusted to have a brightness value of PBV. After step 82, step 83 is executed which captures an image of an overlapping sub-area. This overlapping sub-area may overlap by one or more rows or columns of pixel positions. At step 84, the process adjusts the brightness of the pixels in the newly-acquired area to match the brightness of the pixel(s) in the overlap area. After step 84, step 85 determines if the area is the last sub-area in the image. If it is not, control transfers to step 86 which moves the camera to be in position to image the next sub-area and transfers control to step 83, described above. After step 85 determines that the last sub-area in the image has been processed, the process ends at step 87.

The inventors have determined that the first process, shown in FIGS. 5A, 5B and 7 provides good results when the display device exhibits random brightness errors while the second process, shown in FIGS. 6 and 8 provides good results when the display device exhibits drifting brightness errors.

Those having the benefit of this, my invention, may provide numerous modification such as using different circuitry to implement my invention in hardware or using different software and combinations of hardware and software. These modifications are to be construed as being encompassed within the scope of the present invention as set forth in the appended claims.

What is claimed is:

1. A method for correcting non uniformities in light emitted by an organic light emitting display device comprising a plurality of addressable discrete picture elements (pixels), each of said pixels being driven by a driving current and each having a light emitting efficiency, the method comprising:

a) predicting a decay in the light emitting efficiency for each of said plurality of pixels over a time period by accumulating for each of said pixels a total driving current for each of said pixels during said time period, b) deriving a correction coefficient for each of said pixels based on said predicted decay in the light emitting efficiency, and c) using said correction coefficients, altering said driving current for each of said pixels to compensate for said predicted decay in the light emitting efficiency of each of said plurality of pixels.

2. A method for correcting non uniformities in light emitted by an organic light emitting display device comprising a plurality of addressable discrete picture elements (pixels), each of said pixels being driven by a driving current and each having a light emitting efficiency, the method comprising:

a) predicting a decay in the light emitting efficiency for each of said plurality of pixels over a time period by measuring for each one of said pixels a differential voltage representing a difference between (1) a voltage across the one pixel at one instant which produces a desired current and (2) a voltage across the one pixel at an instant prior to the one instant that produces the desired current, b) deriving a correction coefficient for each of said pixels based on said predicted decay in the light emitting efficiency, and c) using said correction coefficients, altering said driving current for each of said pixels to compensate for said predicted decay in the light emitting efficiency of each of said plurality of pixels.

3. A method for correcting non uniformities in light output by an organic light emitting display device, said device comprising a plurality of addressable discrete picture elements (pixels), each of said pixels driven by a driving current and each pixel having a light output which is a function of the driving current, the method comprising:

a) predicting a change in the light output for each of said plurality of pixels by accumulating, for each of said pixels, a driving current for each of said pixels during an elapsed time, b) compensating for said change in said light output of each of said plurality of pixels by calculating a corresponding change in said driving current, based on the predicted change in light output, and applying said change in said driving current for each of said pixels, respectively.

4. The method according to claim 3 wherein the step of compensating for said change in light output of each of said plurality of pixels further comprises a) measuring a first driving current for each of said pixels and a corresponding first light efficiency at a first time;

b) calculating a second light efficiency for each of said pixels at a second time as function of driving current applied to each of said pixels between said first and second times;

c) altering said first driving current for each of said pixels by a factor proportional to the ratio of the first and second light efficiencies.

5. The method according to claim 3 wherein the step of compensating for said change in light output of each of said plurality of pixels comprises:

a) identifying an initial driving current $I_o$ and decay factor $\tau_o$ for each of said pixels;

b) identifying a first driving current $I_{N-1}$ for each of said pixels at a first time $t_{n-1}$ c) compensating for said change in light output for each of said plurality of pixels by applying a driving current $I_N$ at a second time $t_N$ such that $$I_N = I_{N-1} \exp[I_{N-1}\Delta t_{N-1}/I_o\tau_o]$$

wherein $\Delta t_{N-1}$ represents the duration of time each of said pixels is driven by the driving current $I_{N-1}$.

6. The method according to claim 3 wherein the step of predicting said change in light output further includes establishing an initial state of uniform device light output wherein each of said plurality of pixels is driven by an initial driving current such that each of said pixels provides a desired light output which is substantially the same for all of said plurality of pixels.

7. The method according to claim 6 wherein the step of establishing said initial state further includes the steps of:

a) driving said plurality of pixels each with a driving current corresponding to the desired light output;

b) subdividing said plurality of pixels into a first plurality of pixel arrays each of said first pixel arrays having fewer pixels than the plurality of pixels;

c) observing a light output of said driven pixels in each of said first plurality of pixel arrays with a photodetector device and adjusting the driving current for each of said pixels in each of said first pixel arrays to generate a substantially same photodetector output signal for each pixel in the first plurality of pixel arrays;

d) subdividing said plurality of pixels into a second plurality of arrays each of said second plurality of arrays including more than one of said first pixel arrays;

e) observing the light output of each of said second arrays with the photodetector and adjusting the driving current for each of said first pixel arrays such that each of the second pixel arrays generate a substantially same photodetector output signal for each of the first pixel arrays of said second plurality of arrays;

f) repeating steps (d) and (e) at least one more time increasing the number of pixels in each pixel array until said number of pixels in said pixel array equals the plurality of pixels.

8. The method according to claim 7 wherein said plurality of pixels defines a display area and wherein each of said pixel arrays comprise sub-arrays of pixels defining sub-areas of said display.

9. The method according to claim 8 wherein said sub-arrays of pixels define overlapping sub-areas.

10. The method according to claim 6 wherein the plurality of pixels form an array comprising rows and columns, and wherein the step of establishing said initial state further comprises the steps of:

a) driving said plurality of pixels each with a same driving current;

b) subdividing said plurality of pixels into a plurality of adjacent first sub-arrays of pixels along a row of said array of pixels said sub arrays comprising fewer pixels than a row of said array of pixels;

c) observing a light output of said driven pixels in each of said first plurality of pixel sub-arrays along each row of said array with a CCD detector device and adjusting the driving current for each of said pixels in each of said first plurality of pixel sub-arrays to generate a substantially same CCD output.

11. A method for calibrating a display device comprising an array of individually adjustable discrete light emitting devices (pixels) using a photodetector, the method comprising:

a) observing with said photodetector a first area of said display device array forming a first level sub-array having a first number of pixels and adjusting each of said pixels within said first sub-array to a desired light output;

b) observing with said photodetector a second area forming a first level second sub-array and adjusting each of said pixels within said second sub-array to the desired light output;

c) repeating steps (a) and (b) until all of the display pixels have been adjusted to the desired light output;

d) observing with said photodetector another first area of the device array containing a plurality of said first level sub-arrays to form a second level sub-array;

e) adjusting as a unit each of said first level sub-arrays in said second level sub-array, to have a common light output;

f) observing with said photodetector another second level sub-array containing a plurality of said first level sub-arrays to form another second level sub-array;

g) adjusting as a unit each of said first level sub-arrays in said another second level sub-array, to have a common light output;

h) repeating steps (e) through (g) until all of the display first level sub-arrays have been adjusted to have common outputs;

i) repeating steps (d) through (h) with respectively larger sub-arrays until the sub-array has a size that spans the display array.

12. A method for calibrating a display device comprising an array of individually adjustable discrete light emitting devices (pixels) using an array of photodetectors, the method comprising:

a) observing with said array of photodetector a first area of said display device array forming a first level sub-array having a first number of pixels and adjusting each of said pixels within said first sub-array to a desired light output;

b) observing with said photodetector a second area forming a first level second sub-array, said second sub-array overlapping said first sub-array in at least one pixel position and adjusting each of said pixels within said second sub-array to have a brightness output substantially equal to the light output of the at least one overlapping pixel;

c) repeating step (b) until all of the display pixels have been adjusted to the desired light output.

13. A system for correcting non uniformities in light output by an organic light emitting display device, said device comprising a plurality of addressable discrete picture elements (pixels), each of said pixels driven by a driving current and each pixel having a light output which is a function of the driving current, the system comprising:

a) accumulating means for integrating for each of said pixels the driving current for each of said pixels during elapsed time;

b) means associated with said accumulating means for calculating a corrected driving current, b) means for applying said corrected current to each of said plurality of pixels.

14. The system according to claim 12 wherein the means for calculating said corrected current include means for receiving an input comprising a first current value $I_{N-1}$, a value representing $I_{N-1}\Delta t_{N-1}/I_o\tau_o$ and for generating an output current value $$I_N = I_{N-1}\exp[I_{N-1}\Delta t_{N-1}/I_o\tau_o]$$

wherein $I_N$ is the corrected driving current value.

15. The system according to claim 13 wherein the means for calculating said corrected current operates in the analog signal domain and comprise a bipolar transistor circuit.

16. The system according to claim 12 wherein the means for accumulating, calculating and applying said corrected current are digital means and their respective functions are implemented in software.

17. Apparatus for calibrating a display device comprising an array of individually adjustable discrete light emitting devices (pixels), the apparatus comprising;

a light detector which receives light emitted by the display device;

light measuring means, coupled to the light detector, for measuring light output of a portion said display device array;

adjusting means, responsive to the light measuring means for controlling the portion of the display device array to change the light output of the portion of the display device array;

an xyz translation stage, which moves the light detector parallel to the display device to capture light emitted by respectively different portions of the display device and which moves the light detector perpendicular to the display device to cause the light measuring means to receive light from different-sized portions of the display device array;

a controller coupled to the light detector, the light measuring means, the adjusting means and the translation stage for moving the light detector to measure the light output of respective first portions of the display device array, each of the first portions being substantially equal in size, for adjusting the respective portions of the display device to provide a desired light output; for moving the light detector to measure light output of respective second portions of the display device array, each of said second portions being substantially equal in size and including a plurality of the first portions; and for adjusting each of the second portions to provide substantially equal light output.

18. Apparatus according to claim 17, wherein the light detector is a CCD camera having a plurality of light detecting elements arranged in an array.

19. Apparatus according to claim 17, wherein the light detector is a single photo detector and the controller controls the translation stage such that the first portions of the display device array correspond to respectively different pixels of the display device array.

20. Apparatus for calibrating a display device comprising an array of individually adjustable discrete light emitting devices (pixels), the apparatus comprising:

an array of light detecting elements which receives light emitted by the display device;

light measuring means, coupled to the array of light detecting elements, for measuring light output of a portion said display device array;

adjusting means, responsive to the light measuring means for controlling the portion of the display device array to change the light output of the portion of the display device array;

an xy translation stage, which moves the light detector parallel to the display device to capture light emitted by respective portions of the display device;

a controller coupled to the array of light detecting elements, the light measuring means, the adjusting means and the translation stage, the controller including means for moving the light detector to measure the light output of respective overlapping portions of the display device array, each of the overlapping portions being substantially equal in size and overlapping a previously measured portion in at least one pixel position;

means for adjusting a first one of the portions of the display device to provide a desired light output; and means for adjusting each one of the overlapping portions to have a light output substantially equal to the light output of the at least one overlapping pixel position.

* * * * *